US005538205A

United States Patent [19]

Bitson

[11] Patent Number: 5,538,205

[45] Date of Patent: Jul. 23, 1996

[54] INDUCTIVE LOOK ANGLE SENSOR FOR A RADIATION SEEKER

[75] Inventor: Joseph W. Bitson, Chino, Calif.

[73] Assignee: Hughes Missile Systems Company, Los Angeles, Calif.

[21] Appl. No.: 120,406

[22] Filed: Feb. 11, 1980

[51] Int. Cl.[6] ..... F41G 7/22

[52] U.S. Cl. ..... 244/3.16

[58] Field of Search ..... 244/3.13, 3.16; 250/342; 356/152, 152.1

[56] References Cited

U.S. PATENT DOCUMENTS

| | | | |
|---|---|---|---|
| 2,130,432 | 9/1938 | Schmook | 336/125 |
| 2,407,657 | 9/1946 | Esval | 340/199 |
| 2,419,979 | 5/1947 | Wilson | 340/199 |
| 2,564,018 | 8/1951 | Malmquist et al. | 340/196 |
| 2,694,797 | 11/1954 | Lindbald | 336/125 |
| 2,719,291 | 9/1955 | Wing | 340/199 |
| 2,847,664 | 8/1958 | Lewis | 340/199 |
| 2,896,145 | 7/1959 | Snodgrass | 318/489 |
| 2,980,363 | 4/1961 | Sohonstedt | 33/328 |
| 3,025,024 | 3/1962 | Hawes | 244/3.13 |
| 3,261,006 | 7/1966 | Younkin | 340/199 |
| 3,284,795 | 11/1966 | Fertig et al. | 336/125 |
| 3,286,168 | 11/1966 | Schmidt | 340/199 |
| 3,351,303 | 10/1967 | Depew, Jr. et al. | 244/3.16 |
| 3,377,872 | 4/1968 | Hodson et al. | 34/5.6 E |
| 3,439,256 | 4/1969 | Kahne | 340/199 |
| 3,475,971 | 11/1969 | Binder et al. | 74/5.6 E |
| 3,504,869 | 4/1970 | Evans et al. | 244/3.16 |
| 4,030,807 | 1/1977 | Briney | 244/316 |
| 4,036,453 | 7/1977 | Evans et al. | 244/3.16 |
| 4,039,246 | 8/1977 | Voigt | 244/3.16 |
| 4,185,797 | 1/1980 | Melean | 244/3.16 |
| 4,500,051 | 2/1985 | Cottle, Jr. et al. | 244/3.16 |

FOREIGN PATENT DOCUMENTS

| | | | |
|---|---|---|---|
| 160446 | 1/1964 | U.S.S.R. | 74/5.6 E |

*Primary Examiner*—Charles T. Jordan
*Assistant Examiner*—Christopher K. Montgomery
*Attorney, Agent, or Firm*—Charles D. Brown; Randall M. Heald; Wanda K. Denson-Low

[57] ABSTRACT

An inductive look angle sensor for a guided missile radiation seeker in which the optical system of the seeker is secured to a gimbal ring that is mounted by bearing mounts to a gimbal post that is stationary with respect to the missile airframe, and the gimbal ring is adapted for rotating back and forth relative to the airframe during a missile roll cycle when the look angle of the radiation seeker relative to the airframe is not zero degrees, is disclosed. The sensor includes a first coil wound on the gimbal post; a second coil wound on the gimbal ring for inductive coupling to the first coil; a signal generator coupled to one of the two coils for providing a first alternating signal having a predetermined frequency; and a demodulator coupled to the other coil and the signal generator. The first and second coils are located relative to each other for enabling the other one of the two coils to inductively respond to the first signal by providing a second signal. The demodulator is coupled to the signal generator and the other coil for demodulating the second signal to provide a look angle signal having an amplitude that is proportional to the look angle, a relative phase that indicates the direction of the look angle, and a frequency that is equal to the roll frequency of the missile.

20 Claims, 3 Drawing Sheets

INDUCTIVE LOOK ANGLE SENSOR FOR A RADIATION SEEKER

BACKGROUND OF THE INVENTION

The present invention generally pertains to radiation seekers for guided missiles and is particularly directed to an improvement in look angle sensors for use in such radiation seekers.

Radiation seekers are an integral part of some missile guidance systems. In some guided missiles, infrared (IR) radiation seekers are employed to detect the position of a target. In order for the radiation seeker to determine the direction of the target in relation to the trajectory of the missile it is necessary to ascertain the look angle of the IR radiation seeker.

In guided missiles to which a roll is imparted to the airframe while in flight, the IR radiation seeker includes an optical system that is secured to a gimbal housing that is stationary with respect to the missile airframe. The gimbal ring is adapted for rotating back and forth relative to the airframe during a missile roll cycle when the look angle of the IR radiation seeker relative .to the airframe is not zero degrees.

A look angle sensor is coupled to the optical system of the IR radiation seeker for providing a look angle signal that indicates the look angle of the IR radiation seeker. The look angle signal has an amplitude that is proportional to the look angle, a relative phase that indicates the direction of the look angle and a frequency that is equal to the roll frequency of the missile. In some missile guidance systems, the look angle signal is compared to a signal that is obtained from a radio frequency (RF) radiation antenna that is secured to the missile airframe in a fixed position in order to produce an error signal that is used to guide the missile toward the source of the IR radiation.

A typical prior art look angle sensor that is used for providing a signal to indicate the look angle of an IR radiation seeker in a rolling airframe guided missile includes a potentiometer having a resistance pickoff wiper contact that is coupled to the movable portion of the optical system of the IR radiation seeker. Such a look angle sensor does not always provide a consistently reliable performance because of variations in the pressure of the wiper contact within the potentiometer. When the wiper pressure is too low, the accuracy of the picked-off resistance value degrades in time due to wear of the wiper contact. When the wiper pressure is too high, there is a drift in the signal that is produced.

It is an object of the present invention to provide an accurate and consistently reliable radiation seeker look angle sensor that does not include any variable contacting elements, such as the wiper contact of a potentiometer.

SUMMARY OF THE INVENTION

The present invention provides an inductive look angle sensor for a radiation seeker for a guided missile. It is useful in a rolling airframe guided missile in which the optical system of the seeker is secured to a gimbal ring that is mounted by bearing mounts to a gimbal post that is stationary with respect to the missile airframe, and the gimbal ring is adapted for rotating back and forth relative to the airframe during a missile roll cycle when the look angle of the radiation seeker relative to the airframe is not zero degrees.

The inductive look angle sensor of the present invention includes a first coil wound on the gimbal post; a second coil wound on the gimbal ring for inductive coupling to the first coil; a signal generator coupled to one of the two coils for providing a first alternating signal having a predetermined frequency to the one coil; and a demodulator coupled to other coil and to the signal generator. The first and second coils are located relative to each other for enabling the other one of the two coils to inductively respond to the first signal by providing a second signal that ,includes a carrier signal at the predetermined frequency that is modulated in response to gimbal ring motion to have an envelope having an amplitude that is proportional to the look angle of the radiation seeker, a phase relative to the first signal that indicates the direction of the look angle, and a modulation frequency that is equal to the roll frequency of the missile. The demodulator is coupled to the signal generator and the other coil for providing a look angle signal having an amplitude that is proportional to the look angle, a relative phase that indicates the direction of the look angle, and a frequency that is equal to the roll frequency of the missile.

In the preferred embodiments, the second coil is located symmetrically in relation to the first coil when the look angle is zero degrees for causing the relative phase of the second signal to indicate the direction of the look angle when the gimbal ring rotates.

Additional features of the present invention are described in the description of the preferred embodiment.

DESCRIPTION OF THE PREFERRED EMBODIMENT

The preferred embodiment of the look angle sensor of the present invention is utilized with a dual mode seeker for a guided missile. The dual mode seeker in this embodiment includes an RF seeker and an IR seeker.

Figure 1:
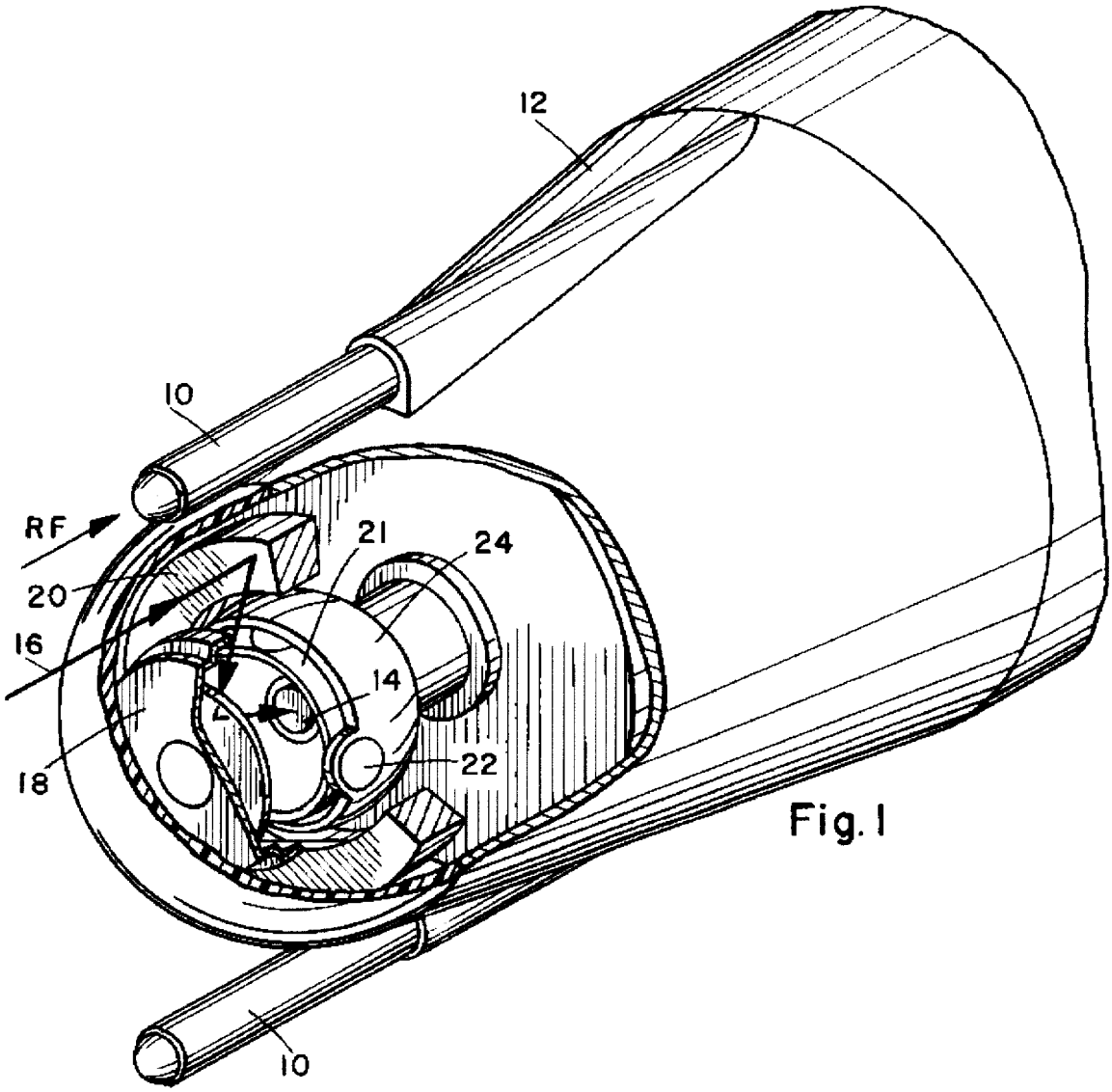
FIG. 1 is a perspective view of a missile nose cone, with a portion of the skin cut away to show an IR seeker deployed on a gimbal assembly within the nose cone, and the relationship of the IR seeker to the RF antennas mounted to the missile airframe.

Referring to FIG. 1, the RF seeker includes two RF antennas 10 that are secured to the airframe 12 of a guided missile.

The IR seeker includes an IR sensor 14 that receives IR radiation 16 that is reflected from the IR seeker optical system 18 and a reflector 20. The IR seeker optical system 18 is secured to a gimbal ring 21 that is mounted by bearing mounts 22 to a gimbal post 24 that is stationary with respect to the missile airframe 12. The gimbal ring 21 is adapted for rotating back and forth relative to the airframe 12 during a missile roll cycle when the look angle of the IR radiation seeker relative to the airframe is not zero degrees.

Figure 2:
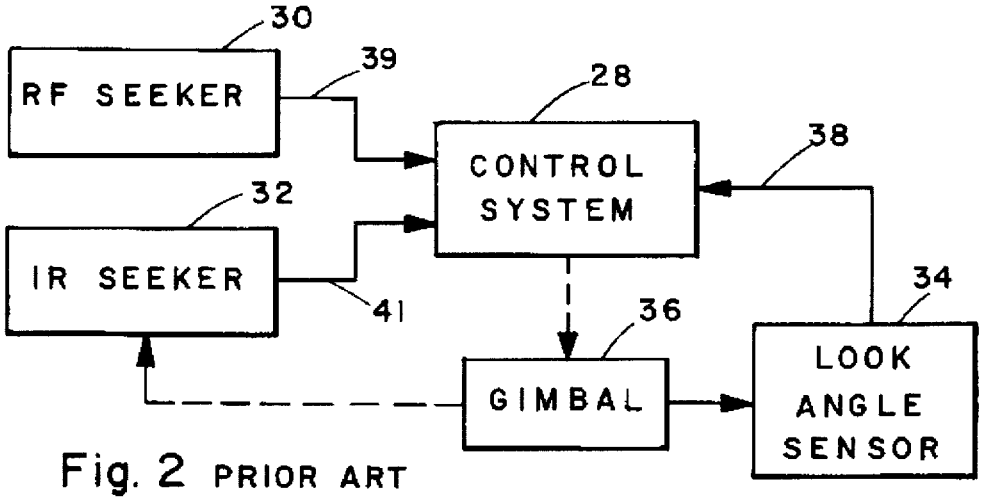
Fig. 2 PRIOR ART
FIG. 2 is a .block diagram for illustrating the function of the look angle sensor in a missile guidance system.

The function of the look angle sensor in a missile guidance system is explained with reference to FIG. 2. The missile control system 28 guides the missile in response to signals received from the RF seeker 30, the IR seeker 32 and the look angle sensor 34. The look angle sensor 34 is coupled to the gimbal assembly 36 for providing a look angle signal (line 38) that indicates the look angle of the IR radiation seeker 32. The look angle signal is compared by the control system 28 with the RF signal on a line 39 from the RF seeker 30 to produce an error signal that is used to guide the missile toward the source of the IR radiation detected by the IR seeker 32. As the trajectory of the missile as changed in response to the error signal the position of the gimbal assembly 36 is also changed, which in turn varies the signal from the IR seeker 32 on a line 41 and the look angle sensed by the look angle sensor 34.

Figure 3:
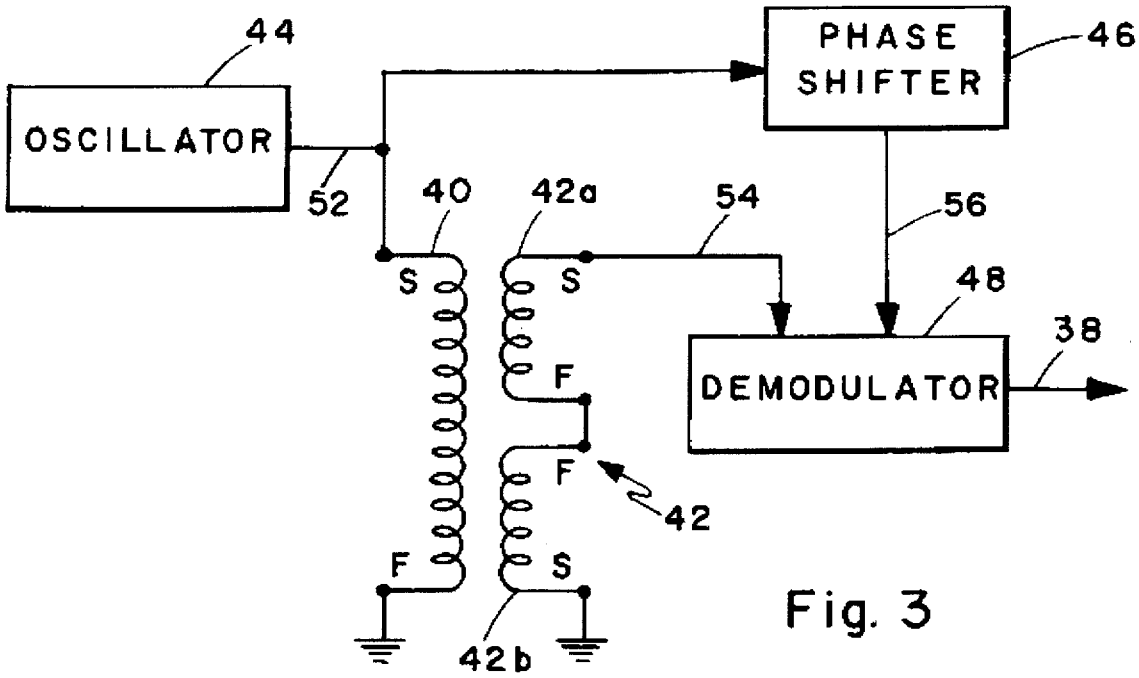
FIG. 3 is a schematic block diagram of the ,inductive look angle sensor of the present invention.
Figure 4:
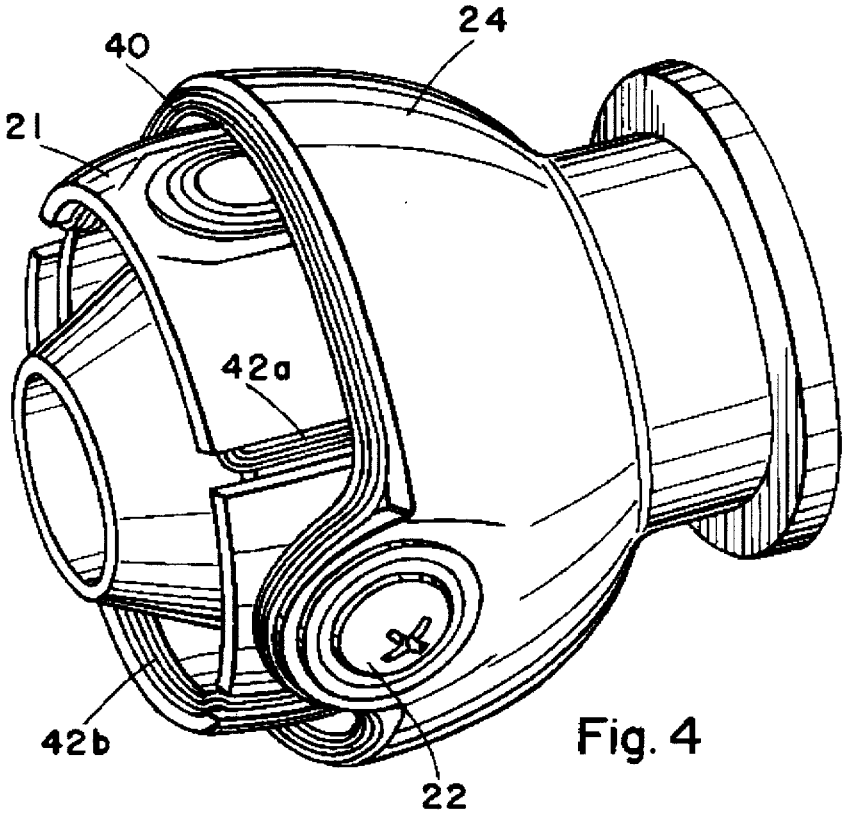
FIG. 4 is a perspective view of the gimbal assembly shown in FIG. 1 having the inductive look angle sensor coils wound thereon.
Figure 5:
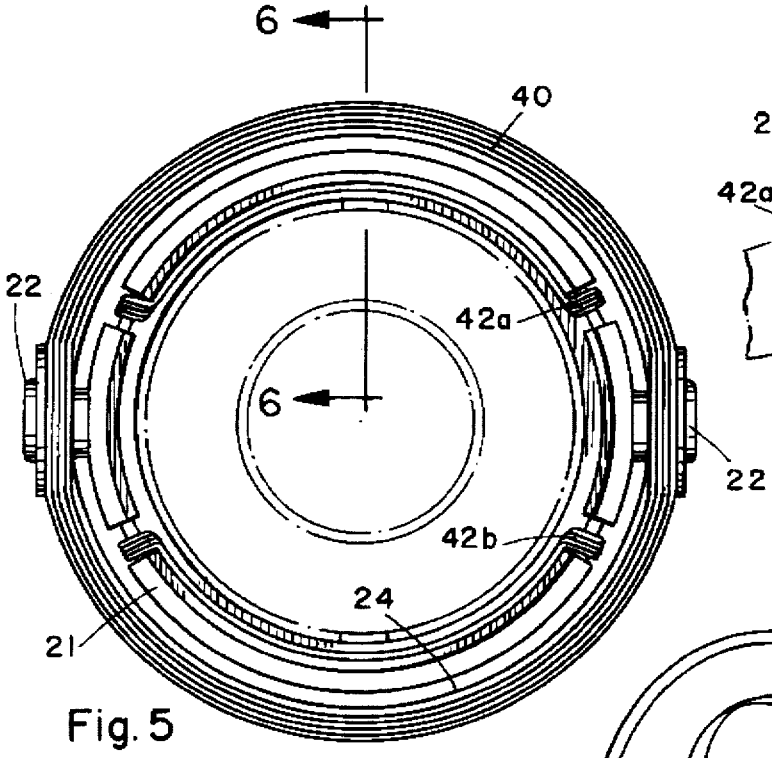
FIG. 5 is a front elevation view of the gimbal assembly shown in FIG. 1 having the inductive look angle sensor coils wound thereon.
Figure 6:
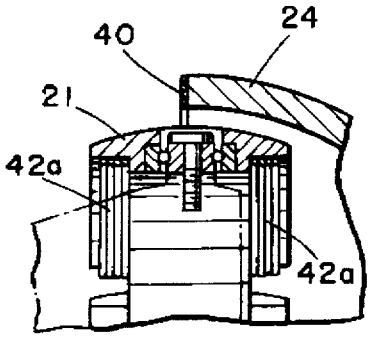
FIG. 6 is a sectional view taken on line 6—6 of FIG. 5.

A schematic diagram of the inductive look angle sensor of the present invention is shown in FIG. 3; and the positioning of the coils of the inductive look angle sensor on the gimbal assembly is shown in FIGS. 4, 5, and 6. The look angle sensor includes a sender coal 40, a receiver coil 42, a signal generator, such as an oscillator 44, a phase shifter 46 and a demodulator 48. The sender coil 40 is wound on the gimbal post 24. The receiver coil 42 consists of two interconnected portions 42*a*, 42*b*, having a rectangular shape that are separately wound on opposite sides of the gimbal rang 21 as defined by the bearing mounts 22 for inductive coupling the receiver coal 40.

Figure 7:
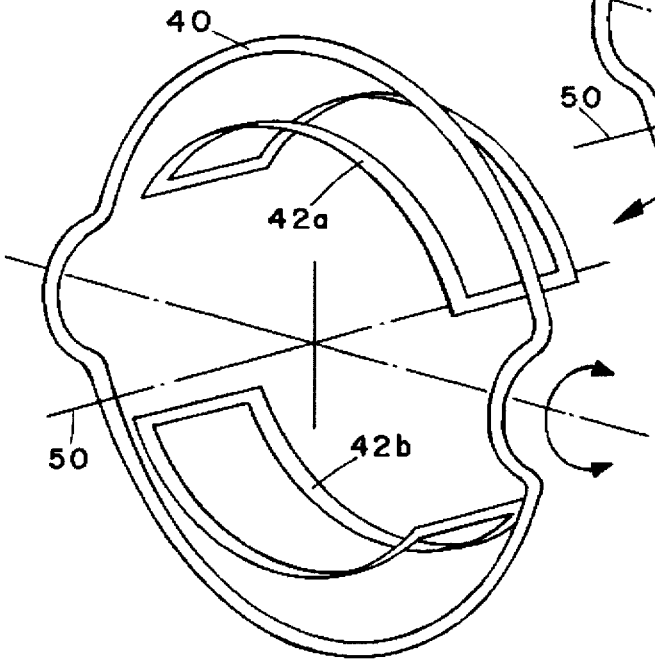
FIG. 7 illustrates diagrammatically the relationship of the coils of the inductive look angle sensor when the look angle is zero degrees.
Figure 8:
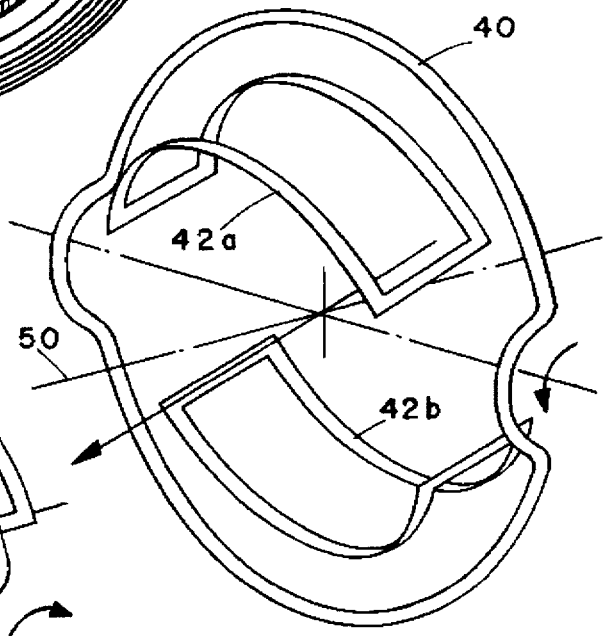
FIG. 8 is a similar diagram to FIG. 7 when the look angle is other than zero degrees.

The shape of the sender and receiver coils 40, 42*a*, 42*b* and their orientation to each other is shown in FIGS. 7 and 8. FIG. 7 shows their relative orientation when the look angle is zero degrees; and FIG. 8 shows their relative orientation when the look angle as approximately 15 degrees. The first coil 40 is primarily aligned substantially orthogonal to the longitudinal axis 50 of the gimbal, and the second coil 42*a*, 42*b* is aligned substantially orthogonal to the first coil 40 when said look angle is zero degrees, as shown in FIG. 7.

The oscillator 44 is coupled to the sender coil 40 for providing a first alternating signal having a predetermined frequency on a line 52 to the sender coil 40. The predetermined frequency is selected as to avoid interference with the performance of the RF seeker and to provide efficient inductive coupling between the sender coil 40 and the receiver coils 42*a*, 42*b*. Frequencies in the range of 5 KHz and 30 KHz have been used successfully, with a frequency of 20 KHz being preferred.

The sender and receiver coils 40, 42*a*, 42*b* are located relative to each other for enabling the receiver coil 42*a*, 42*b* to inductively respond to the first signal on the line 52 by providing a second signal on a line 54. The second signal on the line 54 includes a carrier signal at the predetermined frequency that is modulated in response to the motion of the gimbal ring 21 to have an envelope having an amplitude that is proportional to the look angle of the IR seeker, a phase relative to the first signal on the line 52 that indicates the direction of the look angle, and a modulation frequency that is equal to the roll frequency of the missile.

Alternatively, the sender coil can be wound on the gimbal ring, and the receiver coil would then be wound on the gimbal post.

In the preferred embodiment shown in FIGS. 3 through 8, the receiver coil 42*a*, 42*b* is located symmetrically in relation to the sender coil 40 when the look angle is zero degrees, as shown in FIG. 7, for causing the relative phase of the second signal on the line 54 to indicate the direction of the look angle when the gimbal ring 21 rotates, as shown in FIG. 8. The arrangement of the coils 40, 42*a* and 42*b* described herein is necessary to discriminate between a clockwise or counterclockwise look angle.

The first alternating signal provided on the line 52 to the sender coil 40 is shifted ninety degrees by the phase shifter 46 and is provided on a line 56 to the demodulator 48. The demodulator 48 demodulates the second signal on the line 54 from the receiver coil 42*a*, 42*b* with reference to the signal on the line 56 to provide a look angle signal on the line 38 having an amplitude that is proportional to the look angle, a relative phase that indicates the direction of the look angle, and a frequency that is equal to the roll frequency of the missile.

The inductive look angle sensor of the present invention does not include any variable contacting elements and thereby obviates this factor which affected the accuracy and reliability of prior look angle sensors. The inductive look angle sensor does not contribute significantly to drift and it can readily be integrated into existing seeker designs.

Having described my invention, I now claim:

1. A look angle sensor for a radiation seeker for a guided missile, wherein the optical system of the seeker is secured to a gimbal ring that is mounted by bearing mounts to a gimbal post that is stationary with respect to the missile airframe, and wherein the gimbal ring is adapted for rotating back and forth relative to the airframe during a missile roll cycle when the look angle of the radiation seeker relative to the airframe is not zero degrees, comprising a first coil wound on the gimbal post;

a second coil wound on the gimbal ring for inductive coupling to the first coil;

a signal generator coupled to one of the two coils for providing a first alternating signal having a predetermined frequency to the one coil;

wherein the first and second coils are located relative to each other for enabling the other one of the two coils to inductively respond to said first signal by providing a second signal comprising a carrier signal at the predetermined frequency that is modulated in response to gimbal ring motion to have an envelope having an amplitude that is proportional to said look angle of the radiation seeker, a phase relative to said first signal that indicates the direction of said look angle, and a modulation frequency that is equal to the roll frequency of the missile; and a demodulator coupled to the signal generator and the other coil for providing a look angle signal having an amplitude that is proportional to said look angle, a relative phase that indicates the direction of said look angle, and a frequency that is equal to the roll frequency of the missile.

2. A look angle sensor according to claim 1, wherein the second coil is located symmetrically in relation to the first coil when said look angle is zero degrees for causing said relative phase of said second signal to indicate the direction of said look angle when the gimbal ring rotates.

3. A look angle sensor according to claim 2, wherein the first coil is primarily aligned substantially orthogonal to the longitudinal axis of the gimbal, and the second coil is aligned substantially orthogonal to the first coil when said look angle is zero degrees.

4. A look angle sensor according to claims 2 or 3, wherein the second coil has a rectangular shape.

5. A look angle sensor according to claims 2 or 3, wherein the second coil consists of two interconnected portions having a rectangular shape that are separately wound on opposite sides of the gimbal ring as defined by the bearing mounts.

6. A look angle sensor for a dual mode radiation seeker for a guided missile, wherein the first mode seeker includes an optical system that is secured to a gimbal ring that is mounted by bearing mounts to a gimbal post that is stationary with respect to the missile airframe, wherein the gimbal ring is adapted for rotating back and forth relative to the airframe during a missile roll cycle when the look angle of the first mode seeker relative to the airframe is not zero degrees and the optical system of the second mode seeker is secured to the airframe, comprising a first coil wound on the gimbal post;

a second coil wound on the gimbal ring for inductive coupling to the first coil;

a signal generator coupled to one of the two coils for providing a first alternating signal having a predetermined frequency to the one coil;

wherein the first and second coils are located relative to each other for enabling the other one of the two coils to inductively respond to said first signal by providing a second signal comprising a carrier signal at the predetermined frequency that is modulated in response to gimbal ring motion to have an envelope having an amplitude that is proportional to said look angle of the first mode seeker, a phase relative to said first signal that indicates the direction of said look angle, and a modulation frequency that is equal to the roll frequency of the missile; and a demodulator coupled to the signal generator and the other coil for providing a look angle signal having an amplitude that is proportional to said look angle, a relative phase that indicates the direction of said look angle, and a frequency that is equal to the roll frequency of the missile.

7. A look angle sensor according to claim 6, wherein the second coil is located symmetrically in relation to the first coil when said look angle is zero degrees for causing said relative phase of said second signal to indicate the direction of said look angle when the gimbal ring rotates.

8. A look angle sensor according to claim 7, wherein the first coil is primarily aligned substantially orthogonal to the longitudinal axis of the gimbal, and the second coil is aligned substantially orthogonal to the first coil when said look angle is zero degrees.

9. A look angle sensor according to claims 7 or 8, wherein the second coil has a rectangular shape.

10. A look angle sensor according to claims 7 or 8, wherein the second coil consists of two interconnected portions having a rectangular shape that are separately wound on opposite sides of the gimbal ring as defined by the bearing mounts.

11. A radiation seeker for a guided missile, wherein the optical system of the seeker is secured to a gimbal ring that is mounted by bearing mounts to a gimbal post that is stationary with respect to the missile airframe, wherein the gimbal ring is adapted for rotating back and forth relative to the airframe during a missile roll cycle when the look angle of the radiation seeker relative to the airframe is not zero degrees, characterized by an inductive look angle sensor for providing a signal indicating said look angle of the radiation seeker, comprising a first coil wound on the gimbal post;

a second coil wound on the gimbal ring for inductive coupling to the first coil;

a signal generator coupled to one of the two coils for providing a first alternating signal having a predetermined frequency to the one coil;

wherein the first and second coils are located relative to each other for enabling the other one of the two coils to inductively respond to said first signal by providing a second signal comprising a carrier signal at the predetermined frequency that is modulated in response to gimbal ring motion to have an envelope having an amplitude that is proportional to said look angle of the radiation seeker, a phase relative to said first signal that indicates the direction of said look angle, and a modulation frequency that is equal to the roll frequency of the missile; and a demodulator coupled to the signal generator and the other coil for providing a look angle signal having an amplitude that is proportional to said look angle, a relative phase that indicates the direction of said angle, and a frequency that is equal to the roll frequency of the missile.

12. A seeker according to claim 11, wherein the second coil is located symmetrically in relation to the first coil when said look angle is zero degrees for causing said relative phase of said second signal to indicate the direction of said look angle when the gimbal ring rotates.

13. A seeker according to claim 12, wherein the first coil is primarily aligned substantially orthogonal to the longitudinal axis of the gimbal, and the second coil is aligned substantially orthogonal to the first coil when said look angle is zero degrees.

14. A seeker according to claims 12 or 13, wherein the second coil has a rectangular shape.

15. A seeker according to claims 12 or 13, wherein the second coil consists of two interconnected portions having a rectangular shape that are separately wound on opposite sides of the gimbal ring as defined by the bearing mounts.

16. A dual mode radiation seeker for a guided missile, wherein a first mode seeker includes an optical system that is secured to a gimbal ring that is mounted by bearing mounts to a gimbal post that is stationary with respect to the missile airframe, wherein the gimbal ring is adapted for rotating back and forth relative to the airframe during a missile roll cycle when the look angle of the first mode seeker relative to the airframe is not zero degrees, and the optical system of the second mode seeker is secured to the airframe, characterized by an inductive look angle sensor for providing a signal indicating said look angle of the first mode seeker, comprising a first coil wound on the gimbal post;

a second coil wound on the gimbal ring for inductive coupling to the first coil;

a signal generator coupled to one of the two coils for providing a first alternating signal having a predetermined frequency to the one coil;

wherein the first and second coils are located relative to each other for enabling the other one of the two coils to inductively respond to said first signal by providing a second signal comprising a carrier signal at the predetermined frequency that is modulated in response to gimbal ring motion to have an envelope having an amplitude that is proportional to said look angle of the first mode seeker, a phase relative to said first signal that indicates the direction of said look angle, and a modulation frequency that is equal to the roll frequency of the missile; and a demodulator coupled to the signal generator and the other coil for providing a look angle signal having an amplitude that is proportional to said look angle, a relative phase that indicates the direction of said look angle, and a frequency that is equal to the roll frequency of the missile.

17. A seeker according to claim 16, wherein the second coil is located symmetrically in relation to the first coil when said look angle is zero degrees for causing said relative phase of said second signal to indicate the direction of said look angle when the gimbal ring rotates.

18. A seeker according to claim 17, wherein the first coil is primarily aligned substantially orthogonal to the longitudinal axis of the gimbal, and the second coil is aligned substantially orthogonal to the first coil when said look angle is zero degrees.

19. A seeker according to claims 17 or 18, wherein the second coil has a rectangular shape.

20. A seeker according to claims 17 or 18, wherein the second coil consists of two interconnected portions having a rectangular shape that are separately wound on opposite sides of the gimbal ring as defined by the bearing mounts.

* * * * *